US006250198B1

(12) United States Patent
Vendetti et al.

(10) Patent No.: US 6,250,198 B1
(45) Date of Patent: Jun. 26, 2001

(54) SHOCK ABSORBING MOUNT FOR ADJUSTABLE BARREL

(75) Inventors: Vincent J. Vendetti, Fredericksburg; Michael M. Canaday, King George, both of VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/372,108

(22) Filed: Aug. 11, 1999

(51) Int. Cl.[7] ..... F41A 25/10
(52) U.S. Cl. ..... 89/44.02; 89/198; 42/75.02
(58) Field of Search ..... 89/44.02, 42.01, 89/198; 42/75.02

(56) References Cited

U.S. PATENT DOCUMENTS

| | | | | |
|---|---|---|---|---|
| 3,208,178 | | 9/1965 | Seiderman . | |
| 3,783,738 | * | 1/1974 | Pelat | 89/198 |
| 3,877,167 | | 4/1975 | Keppler . | |
| 5,613,308 | * | 3/1997 | Little | 37/445 |
| 5,655,632 | * | 8/1997 | Valembois | 89/14.3 |

FOREIGN PATENT DOCUMENTS

| | | | |
|---|---|---|---|
| 704640 | 4/1941 | (DE) | 42/75.02 |
| 373517 | 11/1939 | (IT) | 42/75.02 |
| 86389 | 10/1955 | (NO) | 42/75.02 |

* cited by examiner

*Primary Examiner*—Stephen M. Johnson
(74) *Attorney, Agent, or Firm*—James B. Bechtel, Esq.; John P. McMahon, Esq.

(57) ABSTRACT

Disclosed is a mount releasably attached to a launcher/spotting rifle assembly. The mount, when released, allows for the barrel of the spotting rifle of the launcher/spotting rifle assembly to be adjusted in a spherical manner, and when tightened, rigidly affixes the barrel to the launcher/spotting rifle assembly, while at the same time provides shock absorbing means which absorbs high stress from the firing shock typically created by the discharge of the launcher/spotting rifle assembly. The shock absorbing means acts to preserve the rigid and accurate attachment of the barrel to the launcher/spotting rifle assembly.

6 Claims, 3 Drawing Sheets

SHOCK ABSORBING MOUNT FOR ADJUSTABLE BARREL

ORIGIN OF THE INVENTION

The invention described herein was made in the performance of official duties by an employee of the Department of the Navy and may be manufactured, used, licensed by or for the Government for any governmental purpose without the payment of any royalty thereon.

BACKGROUND OF THE INVENTION

1. Field of the Invention

The present invention relates to firearm technology and, more particularly, to a releasable mount, which when loosened allows for spherical adjustment of the barrel of a spotting rifle and, which when tightened, firmly maintains the desired barrel orientation.

2. Description Of the Prior Art

Spotting rifles have means for adjusting the orientation of the barrel of the rifle so as to accurately position the barrel to bring to bear the fire power thereof onto a target. For such adjustment, the barrel needs to be allowed to pivot relative to the rifle, more particularly, relative to the receiver portion of the spotting rifle.

Spotting rifles are also used in conjunction with other firearms, such as a rocket launcher. In such applications, the rifle receiver is rigidly connected to the launch tube of the rocket launcher. Using the weapon is as follows: tracer rounds are fired from the spotting rifle until the gunner, controlling the rocket launcher, feels that he is accurately hitting the target. At this point, the gunner switches the weapon to launch mode and fires the rocket. The rocket and the spotting rounds have the same trajectory allowing the rocket launcher to hit the same target as the tracers.

Prior art spotting rifles used in conjunction with rocket launchers have allowed the barrel to pivot relative to the receiver portion of the spotting rifle, but did so without firmly securing the barrel to the receiver portion of the spotting rifle. Because the barrel was not firmly mounted, the barrel would "jump" when the spotting rifle was fired causing a large group, that is, scattering of bullets, onto the target. The prior art spotting rifles secured the barrel to the receiver portion by using set screws to improve the accuracy of the rifle and, thus, the rocket launcher, but it was determined that the set screws would back out of their capturing holes from the vibration caused by the firing of the spotting rifle and the rocket launcher. In addition, analysis was performed that showed high levels of stress were being encountered at the barrel/set screw interface which caused the loosening of the set screws from their capturing holes. It is desired that a releasable mount be provided which when loosened allows for the adjustment of the orientation of the barrel and, which when tightened, firmly maintains the orientation of the barrel during firing of the spotting rifle and the rocket launcher.

SUMMARY OF THE INVENTION

Accordingly, it is a primary object of the present invention to provide for mounting means such, when loosened, allows for the adjustment of a barrel of spotting rifle, and when tightened, maintains the desired orientation of the barrel, while at the same time absorbs high stress that normally occurs during the firing of the spotting rifle and also during the firing of the associated rocket launcher.

It is another object of the present invention to provide for mounting means that allows for spherical adjustment for the barrel of the spotting rifle so that the spotting rifle may be more effectively used with a rocket launcher.

It is yet another object of the present invention to provide for an adjustable means for the mounting of a barrel that has shock absorbing capabilities so as to maintain the desired orientation of the barrel of the spotting rifle.

It is a further object of the present invention to provide for adjustable mounting means that can be tightened and pinned to the receiver portion of the spotting rifle.

In accordance with these and other objects, the invention provides a firearm comprising a barrel, a receiver portion, a mount, and shock absorbing means. The barrel has first and second ends and serves as a discharge tube for the firearm. The receiver portion of the firearm has means for receiving and holding the second end of the barrel. The mount has means for releasably connecting to the receiver portion. The shock absorbing means is lodged in the mount and interposed between the barrel and the mount.

BRIEF DESCRIPTION OF THE DRAWINGS

The foregoing objects and advantages of the present invention will be more fully understood from the following detailed description having reference to the appended drawings wherein.

DETAILED DESCRIPTION OF THE PREFERRED EMBODIMENTS

Figure 1:
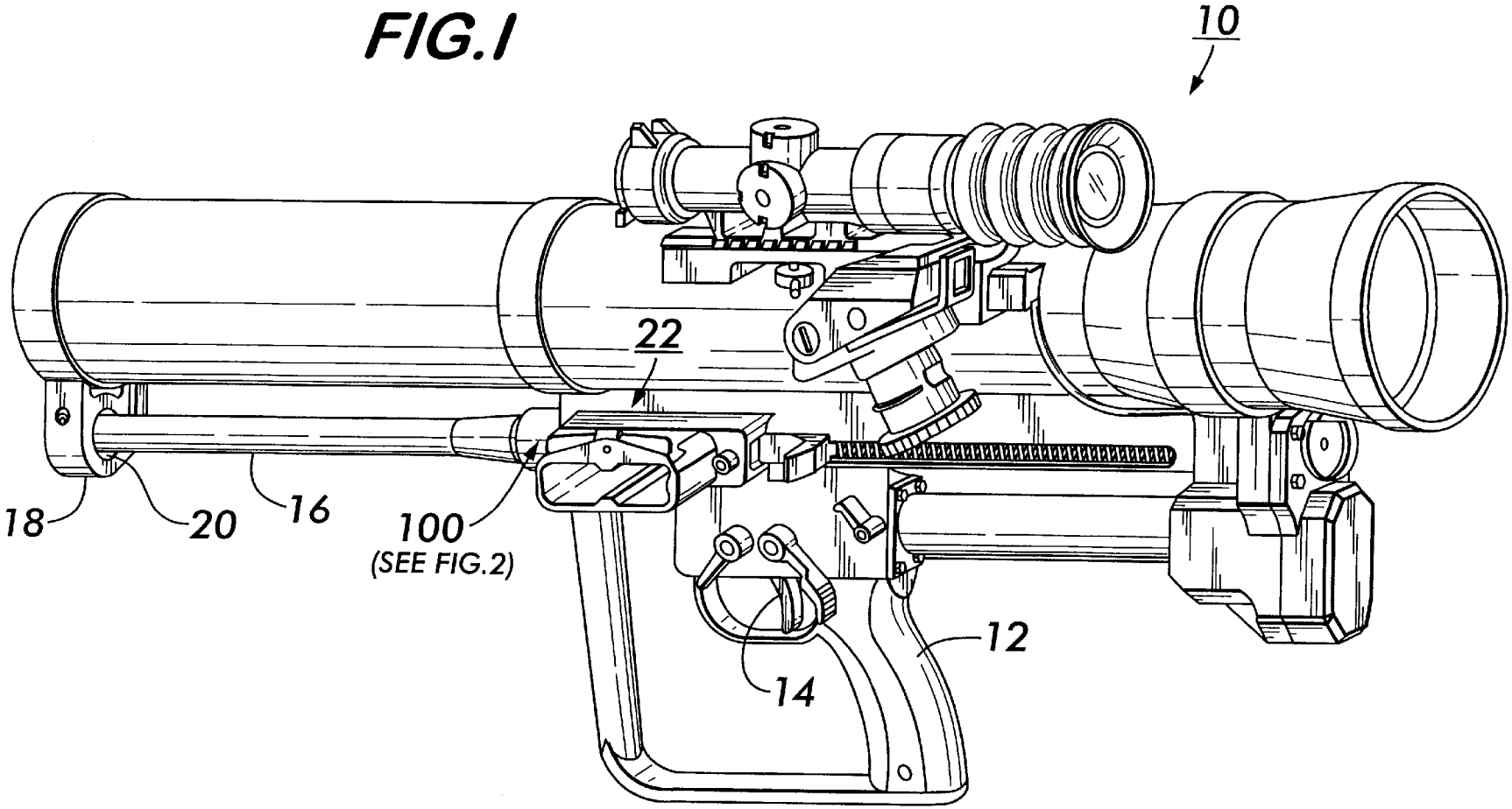
FIG. 1 is an overall view of the launcher/spotter rifle assembly of the present invention.

Referring to the drawings, wherein in the same reference number indicates the same element throughout, there is shown in FIG. 1 an overall view of a typical launcher/spotter rifle assembly designated generally by the reference number 10. The rocket launcher/spotter rifle assembly 10 has a handle 12 that is used in the operation of a trigger 14. The launcher/spotter rifle assembly 10 further comprises a barrel 16 that is connected on the muzzle end thereof to a front bracket 18 of the launcher/spotter rifle assembly 10 by means of bore sighting adjustment device 20, to be further described with reference to FIG. 3, and on the other end thereof to a receiver assembly 22 of the launcher/spotter rifle assembly 10. The barrel 16 is connected to the receiver assembly 22 by means of a mount assembly 100 which is of particular importance to the present invention and may be further described with reference to FIG. 2.

Figure 2:
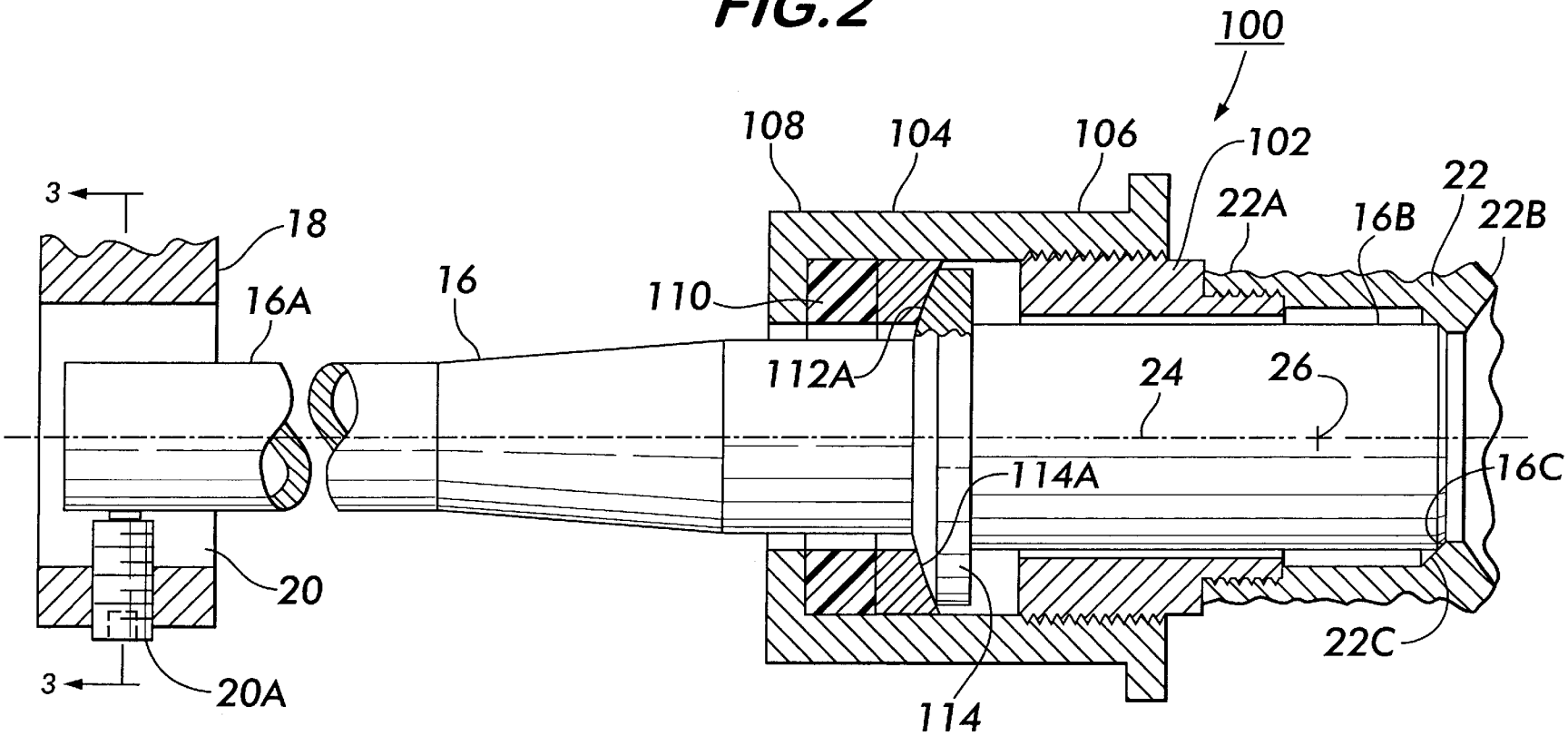
FIG. 2 is a sectional drawing illustrating the adjustable mount of the present invention.

FIG. 2 illustrates the barrel 16, which serves as the discharge tube for a spotting rifle of FIG. 1 and has a first or muzzle end (previously mentioned with regard to FIG. 1) 16A and a second end (previously mentioned with regard to FIG. 1) 16B, as well as having a centerline 24 along which is located a center 26 about which the barrel 16 is rotated in a spherical manner to be described. The spotting rifle is interchangeably referred to herein as simply a rifle or, more generally, as a firearm. Similarly, the launcher/spotter assembly 10 is sometimes referred to herein as a firearm. Although the practice of the invention is particularly suited for a spotting rifle operated in conjunction with a launcher both forming the launcher/spotter rifle assembly 10, the practice of the invention is also applicable to other type firearms. The launcher/spotter assembly 10 further comprises the receiver portion 22, having first and second ends 22A and 22B, respectively.

The mount assembly 100 of FIG. 2 has a threaded insert 102 which interconnects the receiver portion 22 to a barrel clamp 104 of the mount assembly 100. If desired, the threaded insert 102 can be eliminated if the receiver portion 22 is provided with external threads so that the barrel clamp 104 may threadly engage with the receiver portion 22. The barrel clamp 104 has first and second ends 106 and 108, with the first end 106 being threadedly engaged with the threaded insert 102.

The mount assembly 100 further comprises a barrel bushing 110 which provides a shock absorbing means that is interposed between the barrel 16 and the barrel clamp 104. In one preferred embodiment, the shock absorbing means 110 is a urethane compression spring preferably having a spring constant of about 12,000 lbs. per inch. If desired, materials other than urethane may be used for the preferred embodiment so long as the spring constant of 12,000 lbs. per inch or less is maintained. For other embodiments for totally different weapon systems, the barrel bushing 110 may require a higher or lower spring constant than the 12,000 lbs., per inch. For all embodiments, the stiffness of the barrel bushing 100 should be less than that of the surrounding steel.

The mount assembly 100 further preferably comprises a slide washer 112 and a barrel collar 114. The slide washer 112 and the barrel collar 114 have faces 112A and 114A, respectively, that are curved in a complementary manner to each other. The faces 112A and 114A are spherically curved by means of their respective spherical radius relative to the center 26 of rotation of the barrel 16.

The first end 16A of the barrel 16 mates with the barrel sighting adjustment device 20 which is positioned inside of the front bracket 18. The front bracket 18 and barrel sighting adjustment device 20 orient the barrel 16 which is rigidly fixed by the barrel clamp 104. The sighting adjustment device 20 has set screws 20A which may be further described with reference to FIG. 3 which is a sectional view taken along line 3—3 of FIG. 2.

Figure 3:
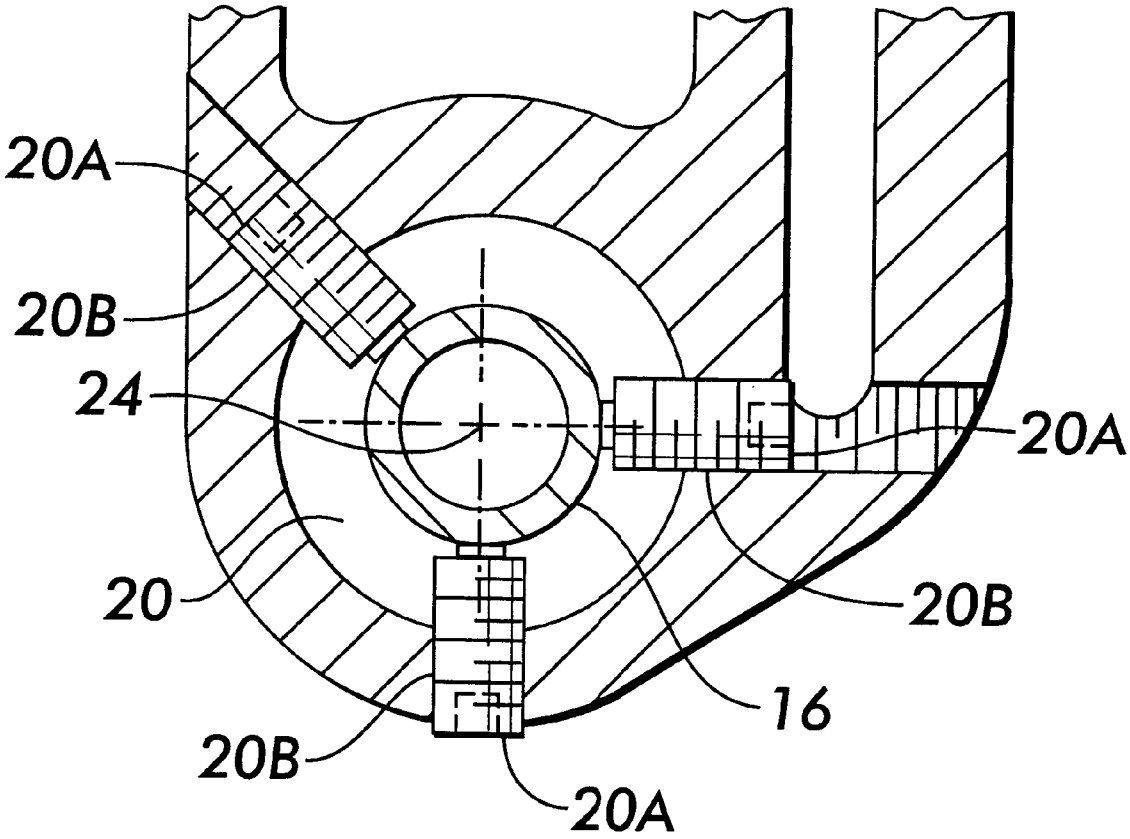
FIG. 3 is a section of the drawing taken along line 3—3 of FIG. 2, illustrating some of the details for connecting the adjustable mount to the launcher/spotter rifle assembly of FIG. 1.

FIG. 3 illustrates three set screws 20A each connected to the first bracket 18 by means of respective self-locking helicoils 20B. Each of the set screws 20A is adjustable to orient the muzzel end 16A to its desired line of sight.

Operation of Mount Assembly 100

In operation, and with reference to FIGS. 2 and 3, the mount assembly 100 is connected to the associated launcher/rifle assembly 10 via the threaded insert 102. More particularly, the threaded insert 102 threads to the receiver portion 22 on one end and to the barrel clamp 104 on the other end. The barrel clamp 104 houses the clamp bushing 110, the slide washer 112 and the barrel collar 114. The second end 16B of the barrel 16 has a spherical face 16C which rests against a spherical face 22C on the receiver portion 22 as shown in FIG. 2. The barrel 16 is rigidly fixed by tightening the barrel clamp 104.

The barrel 16 is adjusted by loosening the barrel clamp 104 which allows the barrel 16 to pivot spherically about the center of rotation 26. Three set screws 20A (shown most clearly in FIG. 3) which are mounted to the front bracket 18 at the muzzle end 16A of the barrel 16 are adjusted to locate the barrel 16 based on bore sighting. The barrel clamp 104 is then tightened fixing the barrel 16 to the receiver portion 22.

In actual operation, when the barrel 16 is firmly attached to the receiver portion 22, the clamp bushing 110, preferably in the form of an urethane spring, acts as the shock absorbing means to absorb the high stress from the firing shock typically created by the discharge of the launcher/spotter rifle assembly 10.

It should now be appreciated that the practice of the present invention provides for the releasably attachable mount, which when loosened, allows for the spherical adjustment of the barrel of a spotting rifle and, which when attached, firmly mounts the adjustment means to the receiver portion of the launcher/spotter rifle assembly 10, while at the same time has shock absorbing means which absorbs the high stress commonly created by the firing shock experience when discharging the launcher/spotter rifle assembly 10.

Although the invention has been described relative to a specific embodiment thereof, there are numerous variations and modifications that will be readily apparent to those skilled in the art in light of the above teaching. It is, therefore, understood that within the scope of the appended claims, the invention may be practiced other than as specifically described.

What is claimed is:

1. A firearm comprising:

(a) a barrel having first and second ends;

(b) a receiver portion of said firearm having means for receiving and holding said second end of said barrel;

(c) a mount having means for releasably connecting to said receiver portion; and (d) shock absorbing means lodged in said mount and interposed between said barrel and said mount.

2. The firearm according to claim 1, wherein said means for releasably connecting said mount to said receiver portion comprises threads on said mount and said receiver portion so as to provide threaded engagement therebetween.

3. The firearm according to claim 1, wherein said shock absorbing means comprises a urethane spring.

4. The firearm according to claim 1 further comprising a slide washer and a barrel collar interposed between said shock absorbing means and said barrel.

5. The firearm according to claim 1 further comprises means for orienting said first end of said barrel.

6. A firearm comprising:

(a) a barrel having first and second ends and having a centerline;

(b) a receiver portion of said firearm having means for receiving and holding said second end of said barrel;

(c) a mount having means for releasably connecting to said receiver portion and means for orienting said barrel about said centerline in a spherical manner and (d) shock absorbing means lodged in said mount and interposed between said barrel and said mount.

* * * * *